US009533504B2

(12) United States Patent
Takagi et al.

(10) Patent No.: US 9,533,504 B2
(45) Date of Patent: Jan. 3, 2017

(54) LIQUID DISCHARGE HEAD AND LIQUID DISCHARGE DEVICE

(71) Applicant: CANON KABUSHIKI KAISHA, Tokyo (JP)

(72) Inventors: Yosuke Takagi, Yokohama (JP); Yuichiro Akama, Tokyo (JP); Kyosuke Toda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/724,078

(22) Filed: May 28, 2015

(65) Prior Publication Data

US 2015/0343779 A1 Dec. 3, 2015

(30) Foreign Application Priority Data

May 30, 2014 (JP) ..... 2014-112184

(51) Int. Cl.
*B41J 2/14* (2006.01)
*B41J 2/175* (2006.01)

(52) U.S. Cl.
CPC ..... *B41J 2/1433* (2013.01); *B41J 2/1752* (2013.01); *B41J 2/17566* (2013.01); *B41J 2002/14491* (2013.01); *B41J 2002/17579* (2013.01)

(58) Field of Classification Search
CPC ... B41J 2/1433; B41J 2/06; B41J 2002/14491; B41J 2/1752
See application file for complete search history.

(56) References Cited

U.S. PATENT DOCUMENTS

| | | | | |
|---|---|---|---|---|
| 4,636,814 | A * | 1/1987 | Terasawa | 347/86 |
| 9,321,274 | B2 * | 4/2016 | Takagi | B41J 2/17526 |
| 2011/0226340 | A1 * | 9/2011 | Tokuno | 137/1 |

FOREIGN PATENT DOCUMENTS

JP 60-34870 A 2/1985

* cited by examiner

*Primary Examiner* — Sarah Al Hashimi
(74) *Attorney, Agent, or Firm* — Canon U.S.A. Inc., IP Division

(57) ABSTRACT

A liquid discharge head, the liquid discharge head including a liquid chamber and two electrode pins that are inserted in the liquid chamber from an upper portion of the liquid chamber. The two electrode pins are used to detect a remaining amount of liquid inside the liquid chamber on a basis of a communication state between the two electrode pins and are disposed on a centerline that is a line extending through a center of an upper surface of the liquid chamber in a moving direction of the liquid discharge head or a single electrode pin is disposed on each side of the centerline with the centerline interposed in between. An expression $X_1 \geq Z_1/0.4$ is satisfied, where $X_1$ is an interval between the two electrode pins and $Z_1$ is a difference in projection lengths of the two electrode pins in the liquid chamber.

16 Claims, 6 Drawing Sheets

FIG. 5A1
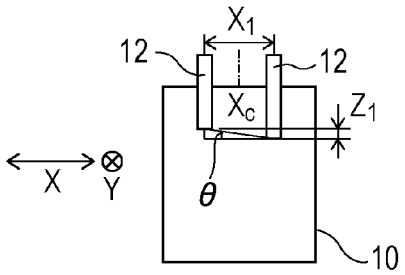
FIG. 5A2
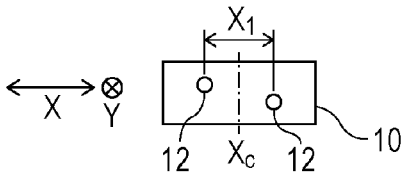
FIG. 5B1
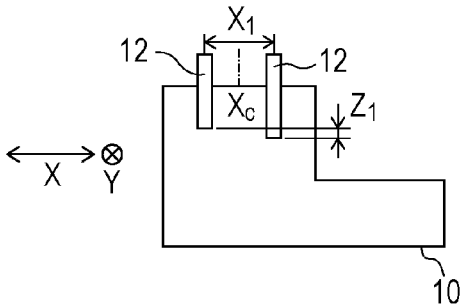
FIG. 5B2
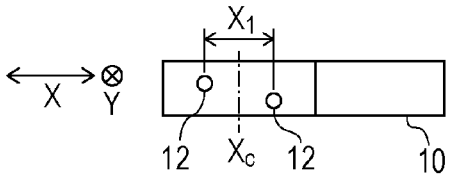
FIG. 5C1
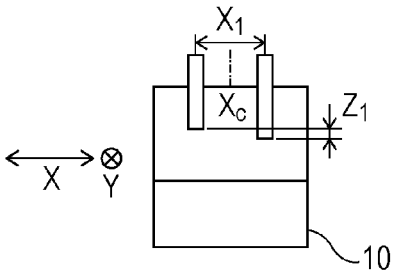
FIG. 5C2
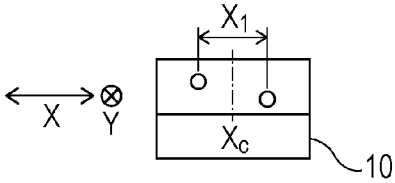
FIG. 5D1
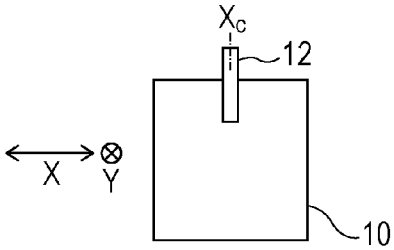
FIG. 5D2
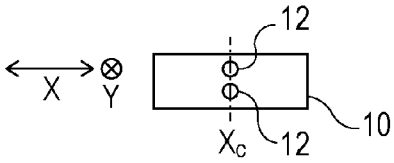

LIQUID DISCHARGE HEAD AND LIQUID DISCHARGE DEVICE

BACKGROUND OF THE INVENTION

Field of the Invention

The present disclosure relates to a liquid discharge head that discharges a liquid and a liquid discharge device.

Description of the Related Art

As an example of a liquid discharge device for performing ink-jet recording, there is a liquid discharge device that supplies liquid from a separate liquid tank that contains a liquid (ink). In such a liquid discharge device, a liquid chamber that temporarily stores liquid supplied form the liquid tank is provided as a part of the liquid discharge head. Furthermore, in some cases, a remaining liquid amount detection mechanism for detecting the remaining amount of liquid stored inside the liquid chamber is provided in the liquid chamber.

As an example of the method of detecting the remaining amount of liquid, there is a so-called prism method in which a prism optical element is provided inside a liquid chamber, in which light for examination incident on the optical element is provided, and in which the intensity of the reflected light is detected to determine whether there is any liquid. However, there are cases in which the prism method fails to perform an accurate detection of the remaining amount when a liquid discharge of high flow rate in particular is performed and the liquid temporarily adheres and remains on the inner wall surfaces of the liquid chamber.

On the other hand, as another example of the remaining liquid amount detection mechanism, a so-called voltage application method is known in which a plurality of electrode pins are inserted in the liquid chamber and determination of whether there is any liquid is made by detecting the communication state between the electrode pins. In the voltage application method, electrical response changes greatly depending on whether or not the liquid is in contact with the two electrode pins at the same time. Accordingly, the method has an advantage in that detection of the remaining amount can be performed in a highly accurate manner even when a liquid discharge of high flow rate is performed.

For example, Japanese Patent Laid-Open No. 60-34870 sets forth two examples in which two electrode pins are inserted in a liquid chamber of a liquid discharge head mounted on a carriage and detection of the remaining amount of liquid is performed with the voltage application method. In the configuration illustrated in the first diagram, two electrode pins with different lengths are inserted towards the lower portion from an upper portion of the liquid chamber.

In the configuration illustrated in the second diagram of Japanese Patent Laid-Open No. 60-34870, one electrode pin is vertically inserted towards the lower portion from the upper portion of the liquid chamber and the other electrode pin is vertically inserted towards the upper portion from the lower portion. According to the configuration, the instance the electrode pin inserted from the upper portion is out of contact with a liquid surface (while the electrode pin inserted from the lower portion is continuously in contact with the liquid), determination is made that the remaining amount of liquid is small (no liquid). In the above configuration, whether there is any liquid or not is determined by whether there is, among the two electrode pins, an electrode pin (the electrode pin inserted from the upper portion of the liquid chamber) that is in contact with the liquid.

As disclosed in Japanese Patent Laid-Open No. 60-34870, by making the positions of the two electrode pins different in the height direction, the amount of liquid in the liquid chamber can be detected in a stepwise manner. In other words, from the point when one of the electrode pins becomes out of contact with the liquid, the electrical quantity flowing between the two electrode pins changes as the liquid surface gradually moves downwards. By measuring the change, detection of the liquid amount in a stepwise manner can be performed. Furthermore, by changing the length of the two electrode pins with respect to each other so that the distal ends thereof are not adjacent to each other, short circuiting between the electrode pins caused by the liquid connecting the distal ends of the two adjacent electrode pins (a bridged state) and erroneous determination that there is a large amount of remaining liquid being made can be restrained.

SUMMARY OF THE INVENTION

The present disclosure is a liquid discharge head that discharges a liquid while in motion, the liquid discharge head including a liquid chamber that temporarily stores the liquid and two electrode pins that are inserted in the liquid chamber from an upper portion of the liquid chamber. The two electrode pins are used to detect a remaining amount of liquid inside the liquid chamber on a basis of a communication state between the two electrode pins, the two electrode pins being disposed on a centerline that is a line extending through a center of an upper surface of the liquid chamber in a moving direction of the liquid discharge head or a single electrode pin is disposed on each side of the centerline with the centerline interposed in between. An expression $X_1 \geq Z_1/0.4$ is satisfied, where $X_1$ is an interval between the two electrode pins, and $Z_1$ is a difference in projection lengths of the two electrode pins in the liquid chamber.

Further features of the present invention will become apparent from the following description of exemplary embodiments with reference to the attached drawings.

BRIEF DESCRIPTION OF THE DRAWINGS

FIGS. 5A1 to 5D2 are schematic diagrams illustrating dimensions and positions of electrode pins of various liquid discharge heads.

DESCRIPTION OF THE EMBODIMENTS

Liquid inside a liquid chamber provided in a liquid discharge head mounted on a carriage of a liquid discharge device ripples (oscillates) upon movement of the carriage and the liquid discharge head. Accordingly, in a configuration having two electrode pins with different lengths inserted inside a liquid chamber, the detection accuracy of the remaining amount of liquid may decrease when detecting the remaining amount of liquid during or immediately after a liquid ejection operation. In other words, the liquid, the amount of which is actually less than the reference amount and that is positioned below the distal ends of the liquid surface detection electrode pins when at a standstill, rippling upon movement of the carriage and the liquid discharge head may come into contact with the detection electrode pins such that erroneous determination that there is a large amount of remaining liquid is made.

Figure 6A:
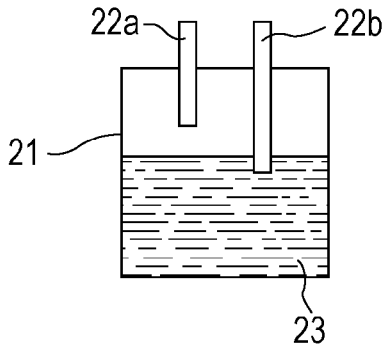
FIGS. 6A to 6C are schematic diagrams for describing the detection of the remaining amount of liquid in an example of a conventional liquid discharge head.
Figure 6B:
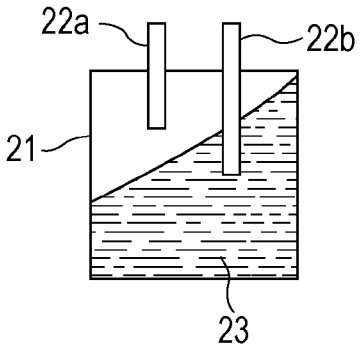
Figure 6C:
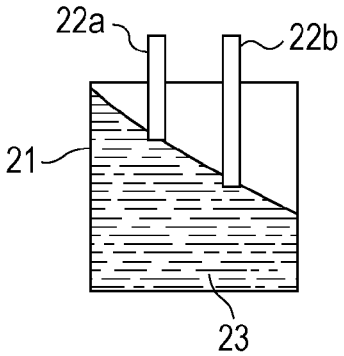

An example in which the detection accuracy of the remaining amount of liquid decreases in a configuration illustrated in FIG. 6A having two electrode pins 22*a* and 22*b* with different lengths inserted downwards from an upper portion of a liquid chamber 21 will be described. In the example, the direction in which the two electrode pins 22*a* and 22*b* are arranged and the moving direction of the carriage coincide with each other. In a state in which the remaining amount of liquid 23 is equivalent to or less than a predetermined amount and the liquid surface is positioned below the distal end of the short electrode pin (detection electrode pin) 22*a*, when, as illustrated in FIG. 6B, the liquid 23 ripples towards the long electrode pin 22*b*, the remaining amount of liquid is determined to be small. However, as illustrated in FIG. 6C, when the liquid 23 ripples towards the short electrode pin 22*a*, the amount of remaining ink is erroneously determined to be large (that there is ink therein). Accordingly, the timing in which the amount of remaining ink is detected to be small is delayed.

Figure 7A:
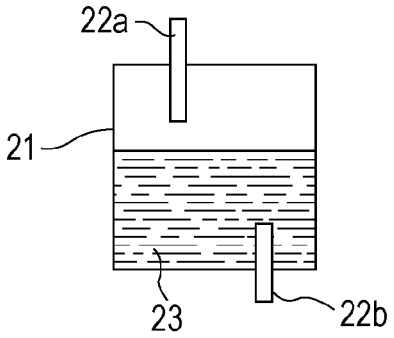
FIGS. 7A to 7C are schematic diagrams for describing the detection of the remaining amount of liquid in another example of a conventional liquid discharge head.
Figure 7B:
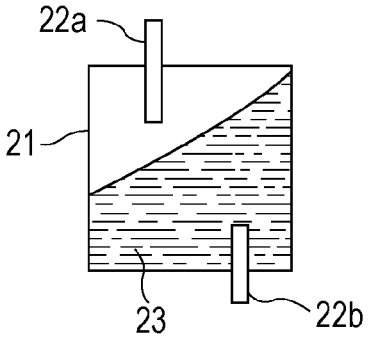

Furthermore, as illustrated in FIG. 7A, in a configuration in which the electrode pins 22*a* and 22*b* are vertically inserted from the upper portion and the bottom portion of the liquid chamber 21 as well, similar to FIG. 6B, when the liquid 23 ripples towards the electrode pin 22*b* that has been inserted from the lower portion, the remaining amount of liquid is determined to be small (see FIG. 7B). However, when the liquid 23 ripples towards the electrode pin 22*a* that has been inserted from the upper portion, the remaining amount of liquid may be erroneously determined to be large (see FIG. 7C). Accordingly, the timing in which the decrease in the remaining amount of liquid is detected is delayed. As described above, in the liquid chamber 21 positioned above the carriage, when detection of the remaining amount of liquid adopting a voltage application method is performed during or immediately after the liquid ejection operation, the timing in which a reduction of the liquid 23 is detected may be delayed due to rippling of the liquid 23 in the moving direction of the carriage. In particular, owing to an increase in the printing speed (the carriage speed) and a decrease in the size (thinning) of the liquid chamber 21 associated with a reduction in the device size in recent liquid discharge devices, the rippling of the liquid 23 associated with the motion of the carriage easily affects the detection. As a result, delay in the timing in which detection of the reduction in the remaining amount of liquid is made has become a problem.

The present disclosure provides a liquid discharge head and a liquid discharge device that are capable of detecting the remaining amount of liquid in a highly accurate manner while suppressing the effect of the rippling liquid.

Hereinafter, an exemplary embodiment of the present invention will be described with reference to the drawings.

Figure 1:
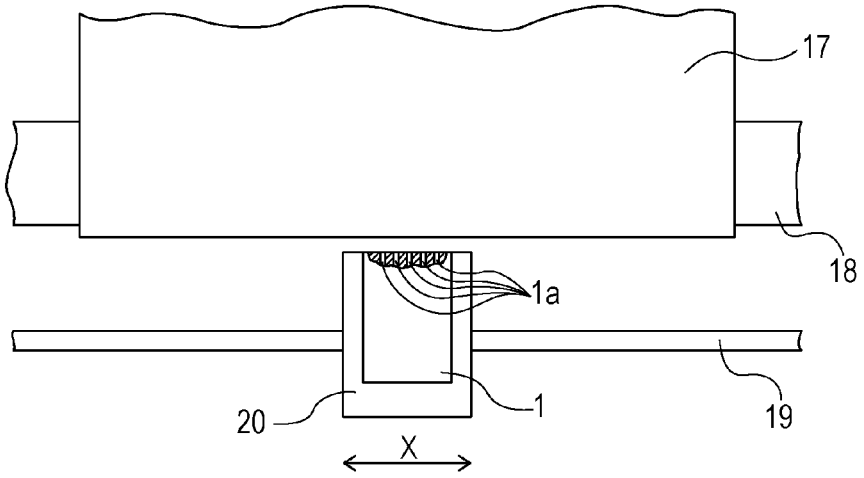
FIG. 1 is a schematic diagram illustrating an essential portion of a liquid discharge device including a liquid discharge head of an exemplary embodiment of the present disclosure.

FIG. 1 schematically illustrates an essential portion of a liquid discharge device including a liquid discharge head 1 of the present disclosure. The liquid discharge device performs recording by discharging liquid (ink) onto a record medium 17, such as recording paper, from discharge ports 1*a* of the liquid discharge head 1. The record medium 17 is supported by a platen 18 at a position opposing the liquid discharge head 1 and is sequentially conveyed by the platen 18. The liquid discharge head 1 is guided by a rail 19 and is mounted on a carriage 20 that reciprocates in the width direction (the X direction) of the record medium 17.

Figure 2:
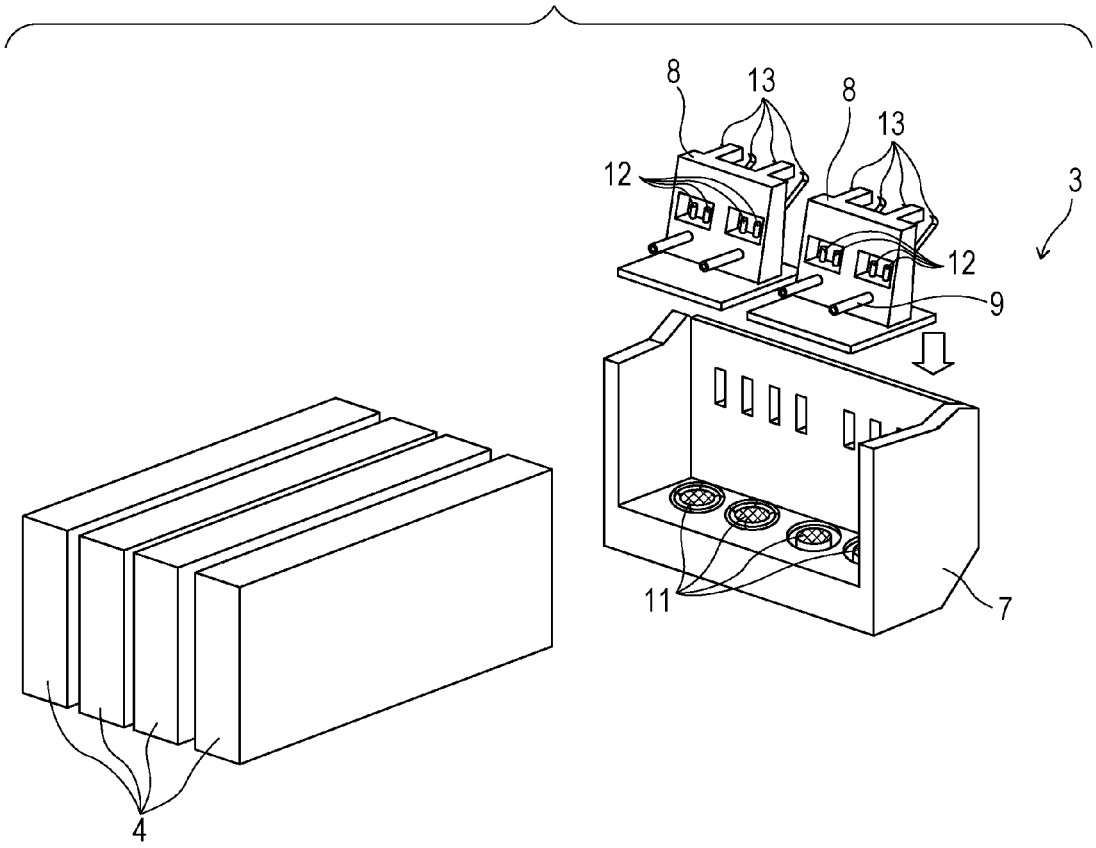
FIG. 2 is an exploded perspective view of the liquid discharge head illustrated in FIG. 1.
Figure 3:
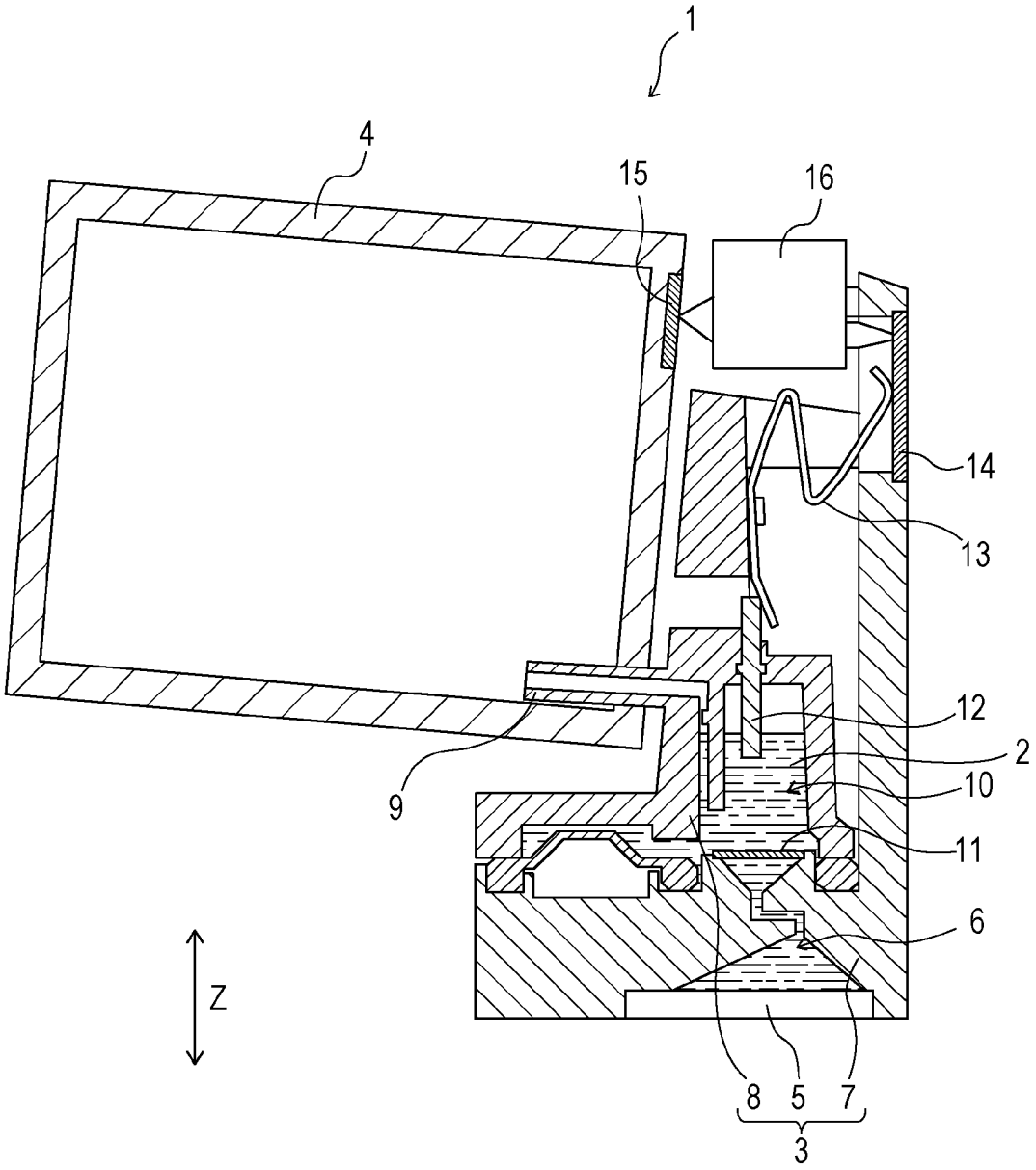
FIG. 3 is a cross-sectional view of the liquid discharge head illustrated in FIG. 1.

Detailed configurations of the liquid discharge head 1 of the present exemplary embodiment are illustrated in FIGS. 2 and 3. The liquid discharge head 1 is mounted on a carriage 20, is reciprocally scanned in the X direction, and forms an image by discharging liquid on the record medium 17. The liquid discharge head 1 mainly includes a discharge cartridge unit 3 that discharges liquid 2 to the outside and liquid tanks 4 that store the liquid 2. The discharge cartridge unit 3 mainly includes element substrates 5 that include discharge ports 1*a* (see FIG. 1), a flow path member 7 that retains the element substrates 5 and that includes flow paths 6 that supply liquid 2 to the element substrates 5, and sub tank units 8. The discharge cartridge unit 3 includes liquid supply tubes 9 that are inserted into the liquid tanks 4 and the flow paths 6 that are in communication with the liquid supply tubes 9. Liquid chambers 10 and filters 11 are provided in the flow paths 6. The liquid chambers 10 temporary store the liquid 2 supplied from the liquid tanks 4 and are provided with a plurality of electrode pins 12 constituting a remaining liquid amount detection mechanism. Spring-piece-like electric connection members 13 each abut against the corresponding electrode pin 12 so as to be in electric communication therewith and, furthermore, each of the electric connection members 13 is connected to an electric substrate 14. An electric wiring portion 15 is provided in each of the liquid tanks 4. The electric wiring portions are connected to the electric substrate 14 through connectors 16.

Each of the element substrates 5 includes the plurality of discharge ports 1*a* and an energy-generating chamber (not shown) that includes therein a plurality of energy-generating elements (a heating element, a pressurizing element, and the like). When the element substrates 5 are mounted in the discharge cartridge unit 3, the flow paths 6 are in communication with the energy-generating chambers inside the element substrates 5.

The liquid discharge head 1 discharges four types (four colors) of liquid ink, includes four liquid tanks 4, and is constituted by four lines of liquid routes.

Individual liquid route of the liquid discharge head 1 will be described. Liquid ink inside each liquid tank 4 passes through the corresponding liquid supply tube 9, is guided to the corresponding liquid chamber 10 in the flow path 6 of the corresponding sub tank unit 8, and is temporarily stored in the corresponding liquid chamber 10. The liquid ink temporarily stored in each liquid chamber passes through the corresponding filter 11, flows into the corresponding flow path 6 and, further, is guided to the energy-generating chamber (not shown) of the corresponding element substrate 5. When electric power is supplied to the energy-generating element (not shown) of each element substrate 5, thermal energy and pressure energy are generated by the energy-generating element and are added to the liquid inside the energy-generating chamber. The liquid to which energy has been added is discharged as a droplet towards the outside from the discharge port.

FIG. 3 illustrates a state in which the liquid tank 4 is empty and a slight amount of liquid 2 that has been supplied from the liquid tank 4 is left inside the liquid chamber 10.

The liquid discharge head 1 of the present exemplary embodiment includes a mechanism (the remaining liquid amount detection mechanism) that detects the remaining amount of liquid inside the liquid chamber 10 of the discharge cartridge unit 3. Specifically, the remaining liquid amount detection mechanism detects that the remaining amount of liquid has become less than a predetermined amount and determines that the remaining amount of liquid is small (no liquid). The remaining liquid amount detection mechanism includes two electrode pins 12 that are inserted in the liquid chamber 10 in a vertical direction (the Z direction) from the upper portion of the liquid chamber 10. Each of the electrode pins 12 is connected to the electric substrate 14 through the corresponding electric connection member 13. Furthermore, an electric signal that is supplied from the liquid discharge device body to the electric substrate 14 and that is for detecting the remaining amount is supplied to each electrode pin 12 through the corresponding electric connection member 13. At this point, the remaining amount of liquid inside each liquid chamber 10 is detected on the basis of the conduction state of the corresponding two electrode pins 12. In most cases, liquid, particularly liquid ink used in forming an image, is a liquid that has electrical conductivity; accordingly, upon application of an electric signal to one of the electrode pins 12, when a response is returned from the other electrode pin 12, it is understood that both of the electrode pins 12 are in contact with the liquid at the same time. In the present exemplary embodiment, the lengths in which the two electrode pins 12 protrude inside the liquid chamber 10 are the same. When the level of the liquid surface inside the liquid chamber 10 is the same or higher than the distal ends (the lower ends) of the electrode pins 12, the two electrode pins 12 are in communication with each other through the liquid and the response of the electric signal is returned. However, when the level of the liquid surface inside the liquid chamber 10 is lower than the distal ends of the electrode pins 12, the two electrode pins 12 are not in communication with each other and the response of the electric signal does not come back. Determination of whether there has been a response of the electric signal can determine whether the level of the liquid surface inside the liquid chamber 10 is the same or above the distal ends of the electrode pins 12. Accordingly, by configuring, as appropriate, the positions of the distal ends of the electrode pins 12 (the protruding lengths of the distal ends of the electrode pins 12 in the liquid chamber 10), determination of whether the amount of liquid inside the liquid chamber 10 is equivalent to or larger than the desired amount can be made. By using the determination result, the timing in which exchange of the liquid tanks 4 is needed and the appropriate timing to perform a recovery operation of the liquid discharge device can be indicated to the user. Regarding the detection of the remaining amount of liquid, a description has been given in which determination of whether there has been a response of the electric signal is made by the existence of a mere electric signal; however, the present disclosure is not limited to the above. In other words, a certain threshold can be set on the electric signal, and if the threshold is exceeded, it can be determined that there is a response, and if the threshold is not exceeded, it can be determined that there is no response. Note that the present disclosure do not detect the amount of liquid inside the liquid chambers 10 in stages but detects whether or not the electrode pins 12 are both in contact with the liquid.

Figure 7C:
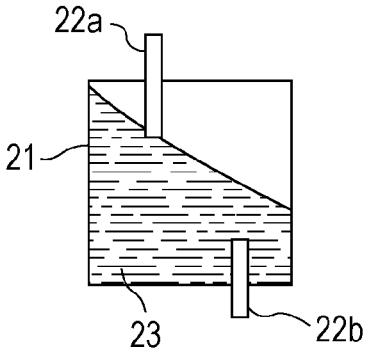

In order to detect the remaining amount of liquid in a more accurate and prompt manner, it is desirable that detection of the remaining amount of liquid is performed during and immediately after the movement of the liquid discharge head 1 performing the liquid ejection operation. As described above, when the liquid discharge head moves, the liquid inside the liquid chamber ripples in the moving direction (the X direction). As a result, conventionally, as illustrated in FIGS. 6C and 7C, even if the liquid 23 inside the liquid chamber 21 is less than a predetermined amount, the two electrode pins 22*a* and 22*b* come in communication with each other and, disadvantageously, the remaining amount of liquid 23 may be erroneously determined to be equivalent to or larger than the predetermined amount. In such a case, the timing in which the reduction of the liquid 23 inside the liquid chamber 21 is detected becomes disadvantageously delayed.

The inventors have considered the above point and found out that, conventionally, one electrode pin 22*a* among the two electrode pins being used as an electrode pin for detection and the other electrode pin 22*b* being configured to be in contact with the liquid for a long period of time are causes of the erroneous determination of the remaining amount of liquid 23 and the delay in the timing of detecting the reduction of the liquid.

Figure 4A:
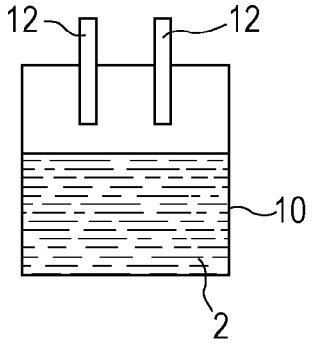
FIGS. 4A to 4C are schematic diagrams for describing the detection of the remaining amount of liquid in the liquid discharge head illustrated in FIG. 1.
Figure 4B:
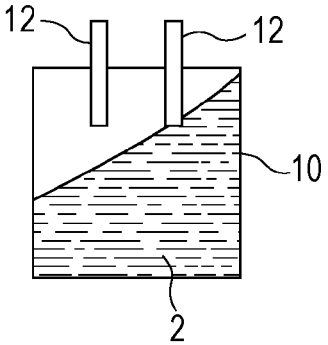
Figure 4C:
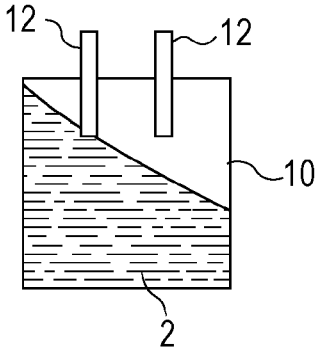

Accordingly, in the present exemplary embodiment, as illustrated in FIG. 4A, the two electrode pins 12 are configured to have the same length and are each configured to function as an electrode pin for detection. With the above, when the remaining amount of liquid 2 is less than a predetermined amount (when the connector pins 12 are not in contact with the liquid 2 when the liquid surface is still), even if the liquid 2 ripples in either of the directions illustrated in FIGS. 4B and 4C, the two electrode pins 12 do not come into contact with the liquid 2 at same time. Accordingly, the two electrode pins 12 barely come into contact with each other and the response of the electric signal does not come back or is very small, thus, erroneous determination can be restrained. As described above, according to the present exemplary embodiment, even in a case in which the liquid 2 inside the liquid chamber 10 oscillates (ripples) during or immediately after the liquid ejection operation, the instance either one of the electrode pins 12 becomes out of contact with the liquid surface, determination is made that the amount of liquid has reduced. In other words, either of the two electrode pins 12 can function as an electrode pin for detection and determination of the reduction (no liquid) in the remaining amount of liquid can be made even at the point when only either one of the electrode pins 12 has become out of contact with the liquid. Accordingly, the delay in the timing of detecting the reduction of the liquid can be restrained from occurring and the remaining amount can be detected with high accuracy.

Since a single remaining liquid amount detection mechanism described above is provided in each of the liquid chambers 10, as illustrated in FIGS. 2 and 3, four remaining liquid amount detection mechanisms are provided in a liquid discharge head 1 including four lines of liquid route. Each of the remaining liquid amount detection mechanisms includes two electrode pins 12.

In the exemplary embodiment described above, the lengths of the two electrode pins 12 that protrude in the liquid chamber 10 from the upper portion of the liquid chamber 10 are the same; however, the lengths do not have to be strictly the same and there are cases in which similar effects to those of the exemplary embodiment described above can be obtained. Specifically, as illustrated in FIGS.

5A1 and 5A2, a single electrode pin 12 is disposed on each side of a centerline $X_c$ with the centerline $X_c$ interposed in between, the centerline $X_c$ being a line extending through the center of the upper surface of the liquid chamber 10 in the moving direction (the X direction) of the liquid discharge head 1. Furthermore, a relationship between an interval $X_1$ between the two electrode pins in the X direction and a difference $Z_1$ in the projection lengths of the two electrode pins 12 in the liquid chamber 10 satisfies $X_1 \geq Z_1/0.4$, in other words, $0.4X_1 \geq Z_1$. In such a case, if an angle θ of the liquid surface with respect to the horizontal surface when the liquid 2 is oscillated is smaller than $\tan^{-1}(Z_1/X_1)=\tan^{-1}(0.4)$=about 22 degrees, then, in a state in which the long electrode pin 12 is just in contact with the liquid 2, contact of the short electrode pin 12 with the liquid 2 can be prevented. In other words, when the angle θ during oscillation is under about 22 degrees, the two electrode pins 12 being in contact with the liquid 2 at the same time and erroneous detection that the remaining amount of liquid 2 is large can be prevented.

If $X_1 \geq Z_1/0.3$, in other words, if $0.3X_1 \geq Z_1$, when the angle θ of the liquid surface during oscillation is smaller than $\tan^{-1}(Z_1/X_1)=\tan^{-1}(0.3)$=about 17 degrees, then, the two electrode pins 12 being in contact with the liquid 2 at the same time and erroneous detection that the remaining amount of liquid 2 is large can be prevented. If $X_1 \geq Z_1/0.2$, in other words, if $0.2X_1 \geq Z_1$, when the angle θ of the liquid surface during oscillation is smaller than $\tan^{-1}(Z_1/X_1)=\tan^{-1}(0.2)$=about 11 degrees, then, the two electrode pins 12 being in contact with the liquid 2 at the same time and erroneous detection that the remaining amount of liquid 2 is large can be prevented. If $X_1 \geq Z_1/0.1$, in other words, if $0.1X_1 \geq Z_1$, when the angle θ of the liquid surface during oscillation is smaller than $\tan^{-1}(Z_1/X_1)=\tan^{-1}(0.1)$=about 6 degrees, then, the two electrode pins 12 being in contact with the liquid 2 at the same time and erroneous detection that the remaining amount of liquid 2 is large can be prevented. Accordingly, after estimating the angle θ of the liquid surface during oscillation caused by movement of the liquid discharge head 1 by taking the moving speed of the carriage, the viscosity and the specific gravity of the liquid, and the like into consideration, and, in some cases, through experimental verification, the dimensions and positions of the electrode pins 12 may be determined so that $X_1$ and $Z_1$ bear an appropriate relationship with respect to each other.

FIGS. 5B1 to 5C2 illustrates modifications in which the shape of the liquid chamber 10 have been changed. Defining $X_1$ and $Z_1$ in a manner described above is effective even if the shape of the lower portion of the liquid chamber 10 is extended in the X direction as illustrated in FIGS. 5B1 and 5B2 and even if the shape of the lower portion of the liquid chamber 10 is extended in a direction orthogonal to the X direction (the Y direction) as illustrated in FIGS. 5C1 and 5C2. In either of the shapes, a single electrode pin 12 is provided on each side of the centerline $X_c$ with the centerline $X_c$ interposed in between, the centerline $X_c$ being a line extending through the center of the upper surface of the liquid chamber 10 in the X direction.

Furthermore, as illustrated in FIGS. 5D1 and 5D2, when $X_1=0$, in other words, when either of the two electrode pins 12 are positioned on the centerline $X_c$ that is a line extending through the center of the upper surface of the liquid chamber 10 in the X direction, then the length of the two electrode pins 12 may be made the same such that $Z_1=0$.

By employing the configurations described above, even during or immediately after the liquid ejection operation, the remaining amount of liquid inside the liquid chamber can be detected in a highly accurate manner. Accordingly, the need to exchange the liquid tanks and the timing to conduct the recovery operation of the liquid discharge head can be notified to the user without delay. Furthermore, since there is no need to perform detection of the remaining amount by temporarily stopping the liquid ejection operation, the throughput does not have to be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-112184, filed May 30, 2014, which is hereby incorporated by reference herein in its entirety.

What is claimed is:

1. A liquid discharge head that discharges a liquid while in motion, the liquid discharge head comprising:

a liquid chamber that temporarily stores the liquid; and two electrode pins that are inserted in the liquid chamber from an upper portion of the liquid chamber, wherein the two electrode pins are used to detect a remaining amount of liquid inside the liquid chamber on a basis of a communication state between the two electrode pins, and wherein the two electrode pins are disposed at opposite sides of a bisector line that bisects an upper surface of the liquid chamber in a moving direction of the liquid discharge head and that is perpendicular to the moving direction, one electrode pin at each side of the bisector line, and $$X_1 \geq Z_1/0.4$$

is satisfied, where $X_1$ is an interval between the two electrode pins and $Z_1$ is a difference in projection lengths of the two electrode pins in the liquid chamber.

2. The liquid discharge head according to claim 1, wherein $$X_1 \geq Z_1/0.3.$$

3. The liquid discharge head according to claim 1, wherein $$X_1 \geq Z_1/0.2.$$

4. The liquid discharge head according to claim 1, wherein $$X_1 \geq Z_1/0.1.$$

5. The liquid discharge head according to claim 1, wherein the projecting lengths of the two electrode pins in the liquid chamber are the same.

6. The liquid discharge head according to claim 1, wherein the liquid chamber is disposed between a liquid tank in which the liquid is stored and an element substrate that includes a discharge port that discharges the liquid.

7. The liquid discharge head according to claim 1, wherein an angle of a liquid surface of the liquid in the liquid chamber with respect to a horizontal surface when the liquid discharge head is moved is less than 22 degrees.

8. The liquid discharge head according to claim 1, wherein a lower region of the liquid chamber in a gravity direction has a length greater than the length of an upper region of the liquid chamber in the gravity direction as measured in the moving direction of the liquid discharge head.

9. A liquid discharge device, comprising a liquid discharge head, and a carriage that reciprocates and on which the liquid discharge head is mounted, the liquid discharge head being configured to discharge a liquid while in motion, and comprising:

a liquid chamber that temporarily stores the liquid; and two electrode pins that are inserted in the liquid chamber from an upper portion of the liquid chamber, wherein the two electrode pins are used to detect a remaining amount of liquid inside the liquid chamber on a basis of a communication state between the two electrode pins, and wherein the two electrode pins are disposed at opposite sides of a bisector line that bisects an upper surface of the liquid chamber in a moving direction of the liquid discharge head and that is perpendicular to the moving direction, one electrode pin at each side of the bisector line, and $$X_1 \geq Z_1/0.4$$

is satisfied, where $X_1$ is an interval between the two electrode pins and $Z_1$ is a difference in projection lengths of the two electrode pins in the liquid chamber.

10. The liquid discharge device according to claim 9, wherein $$X_1 \geq Z_1/0.3.$$

11. The liquid discharge device according to claim 9, wherein $$X_1 \geq Z_1/0.2.$$

12. The liquid discharge device according to claim 9, wherein $$X_1 \geq Z_1/0.1.$$

13. The liquid discharge device according to claim 9, wherein the projecting lengths of the two electrode pins in the liquid chamber are the same.

14. The liquid discharge device according to claim 9, wherein the liquid chamber is disposed between a liquid tank in which the liquid is stored and an element substrate that includes a discharge port that discharges the liquid.

15. The liquid discharge device according to claim 9, wherein an angle of a liquid surface of the liquid in the liquid chamber with respect to a horizontal surface when the liquid discharge head is moved is less than 22 degrees.

16. The liquid discharge device according to claim 9, wherein a lower region of the liquid chamber in a gravity direction extends against an upper region of the liquid chamber in the gravity direction has a length greater than the length of an upper region of the liquid chamber in the gravity direction as measured in the moving direction of the liquid discharge head.

* * * * *